US007900323B2

(12) United States Patent
Lin

(10) Patent No.: US 7,900,323 B2
(45) Date of Patent: Mar. 8, 2011

(54) HINGE AND A LAMP WITH THE HINGE

(75) Inventor: Shu-Mu Lin, Shulin (TW)

(73) Assignee: Shin Zu Shing Co., Ltd., Taipei Hsien (TW)

( * ) Notice: Subject to any disclaimer, the term of this patent is extended or adjusted under 35 U.S.C. 154(b) by 372 days.

(21) Appl. No.: 12/244,021

(22) Filed: Oct. 2, 2008

(65) Prior Publication Data

US 2010/0083468 A1 Apr. 8, 2010

(51) Int. Cl.
*E05D 3/06* (2006.01)
*E05D 11/10* (2006.01)

(52) U.S. Cl. ..... 16/366; 16/254; 16/260; 16/319; 16/324

(58) Field of Classification Search ..... 16/254, 16/255, 256, 257, 259, 261, 262, 366, 388, 16/354, 231, 229, 235, 239, 242, 249, 319, 16/321, 324, 325, 352, 277, 284, 285, 292, 16/312, 314, 317; 403/157; 15/110
See application file for complete search history.

(56) References Cited

U.S. PATENT DOCUMENTS

| | | | | | |
|---|---|---|---|---|---|
| 769,035 | A * | 8/1904 | Walter | 16/330 |
| 917,768 | A * | 4/1909 | Jordan | 16/325 |
| 1,125,265 | A * | 1/1915 | Carter | 16/330 |
| 1,208,422 | A * | 12/1916 | Way | 16/242 |
| 1,440,713 | A * | 1/1923 | Ausbourne | 16/324 |
| 1,484,536 | A * | 2/1924 | Way | 16/242 |
| 1,885,384 | A * | 11/1932 | Snow | 403/65 |
| 2,938,746 | A * | 5/1960 | Willman | 292/336.3 |
| 2,966,697 | A * | 1/1961 | Mintz | 16/332 |
| 3,251,088 | A * | 5/1966 | Boundy | 16/242 |
| 3,448,486 | A * | 6/1969 | Wright | 16/324 |
| 3,629,900 | A * | 12/1971 | Beerli, Jr. | 16/349 |
| 3,744,085 | A * | 7/1973 | Griego | 16/325 |
| 4,186,905 | A * | 2/1980 | Brudy | 248/478 |
| 4,326,321 | A * | 4/1982 | Colognori | 24/265 B |
| 4,628,567 | A * | 12/1986 | Brockhaus et al. | 16/267 |
| 4,929,113 | A * | 5/1990 | Sheu | 403/157 |
| 5,039,118 | A * | 8/1991 | Huang | 280/47.371 |
| 5,303,291 | A * | 4/1994 | Takagi et al. | 379/433.13 |
| 5,845,366 | A * | 12/1998 | Kuroda | 16/229 |
| 5,881,150 | A * | 3/1999 | Persson | 379/433.13 |
| 6,009,568 | A * | 1/2000 | Miyazaki | 4/236 |
| 6,085,387 | A * | 7/2000 | Han | 16/330 |
| 6,178,599 | B1 * | 1/2001 | Worden et al. | 16/386 |
| 6,519,812 | B2 * | 2/2003 | Ko et al. | 16/354 |
| 6,629,801 | B2 * | 10/2003 | Cheng | 403/101 |
| 6,665,906 | B2 * | 12/2003 | Li | 16/330 |
| 7,140,074 | B2 * | 11/2006 | Han et al. | 16/366 |
| 7,484,271 | B2 * | 2/2009 | Oshima et al. | 16/366 |
| 7,515,707 | B2 * | 4/2009 | Ka et al. | 379/433.12 |
| 7,735,196 | B2 * | 6/2010 | Centmayer et al. | 16/334 |

(Continued)

*Primary Examiner* — Thomas B Will
*Assistant Examiner* — Emily M Morgan
(74) *Attorney, Agent, or Firm* — Alan Kamrath; Kamrath & Associates PA

(57) ABSTRACT

A lamp has multiple arms and multiple hinges mounted between two adjacent arms. The hinge has a stationary leaf, multiple pivot assemblies being mounted in the stationary leaf and multiple brackets being respectively connected to the pivot assemblies and two corresponding brackets are attached to each arm. Each pivot assembly has a shaft and a locking nut being mounted on the shaft and selectively engaging a locking hole of each bracket. Since the locking nuts selectively engage the locking holes of the brackets, an angle between the adjacent arms can be adjusted and fixed. Further, two adjacent arms do not influence each other's position, which is convenient for adjusting.

12 Claims, 8 Drawing Sheets

U.S. PATENT DOCUMENTS

| | | | | |
|---|---|---|---|---|
| 7,787,914 | B2 * | 8/2010 | Ahn et al. | 455/575.3 |
| 2005/0236869 | A1 * | 10/2005 | Ka et al. | 296/192 |
| 2007/0226955 | A1 * | 10/2007 | Cho et al. | 16/354 |
| 2008/0307608 | A1 * | 12/2008 | Goto | 16/366 |
| 2009/0056073 | A1 * | 3/2009 | Lin | 16/235 |
| 2009/0199364 | A1 * | 8/2009 | Patterson | 16/297 |
| 2010/0218344 | A1 * | 9/2010 | Van Gennep | 16/327 |

* cited by examiner

HINGE AND A LAMP WITH THE HINGE

BACKGROUND OF THE INVENTION

1. Field of the Invention

The present invention relates to a hinge and a lamp with the hinge, especially to a hinge that is easily positioned to allow a lamp comprising the hinge to be easily adjusted.

2. Description of the Prior Arts

A lamp is placed on a desk, table or the like and has a base, multiple arms, multiple hinges and a light. One arm is mounted on the base and the other arms are connected sequentially to each other, and the hinges are respectively mounted between two adjacent arms. The light is connected to one of the arms. Therefore, the hinge allows the arm to pivot relative to each other and to adjust a height and a position of the light relative to the desk and allows the lamp to be folded.

With reference to FIG. 7, a conventional hinge (60) for a lamp comprises a stationary leaf (61), four brackets (62, 62') and four pivot assemblies (63).

The stationary leaf (61) has two opposite walls (611, 611').

The brackets (62, 62') are mounted on the walls (611, 611') of the stationary leaf (61) in pairs. Each bracket (62, 62') has a pivot end (621) and a fastening end (622, 622'). The pivot ends (621) of one pair of brackets (62) are mounted on opposite walls (611) of the stationary leaf (61) and are opposite to each other. The fastening ends (622) of one pair of the brackets (62) protrude out from the walls (611) of the stationary leaf (611) and corresponds to each other.

The pivot assemblies (63) are mounted through the walls (611, 611') of the stationary leaf (61) and the brackets (62, 62') to allow the brackets (62, 62') to pivot relative to the stationary leaf (61). Each pivot assembly (63) has a shaft (631), multiple washers (632) and a fastener (633). The shaft (631) is mounted through the pivot end (621) of the corresponding bracket (62) and the corresponding wall (611, 611') of the stationary leaf (61). The washers (632) are securely mounted around the shaft (631) adjacent to the corresponding wall (611) of the stationary leaf (61) to provide a frictional force of the hinge (60). The fastener (633) is mounted securely on the shaft (631) to tighten the pivot assemblies (63) against the stationary leaf (61) and the brackets (62, 62').

With further reference to FIG. 8, the conventional hinge (60) as described is mounted between two arms (70, 70') of the lamp. The corresponding fastening ends (622, 622') of each pair of brackets (62, 62') are fastened to two opposite sides of one arm (70, 70'). Therefore, an angle between the arms (70, 70') is adjusted through the conventional hinge (60).

Although the frictional force of the washers (632) allows the arms (70, 70') and the brackets (62, 62') to be positioned at a specific angle relative to the stationary leaf (61), the frictional force of the washers (632) gradually fails with long-term use and the arms (70, 70') sag or collapse.

Furthermore, since the conventional hinge (60) has no locking structures, the arms (70, 70') and corresponding brackets (62, 62') rotate relative to the stationary leaf (61) at the same time. Thus, the angle between the arms (70, 70') is not accurately adjusted easily causing frustration.

To overcome the shortcomings, the present invention provides a hinge and a lamp with the hinge to mitigate or obviate the aforementioned problems.

SUMMARY OF THE INVENTION

The main objective of the present invention is to provide a hinge and a lamp with the hinge.

The lamp has multiple arms and multiple hinges mounted between two adjacent arms. The hinge has a stationary leaf, multiple pivot assemblies being mounted in the stationary leaf and multiple brackets being respectively connected to the pivot assemblies and two corresponding brackets are attached to each arm. Each pivot assembly has a shaft and a locking nut being mounted on the shaft and selectively engaging a locking hole of each bracket.

Since the locking nuts of the pivot assemblies selectively engage the locking holes of the brackets, an angle between the adjacent arms can be adjusted and fixed. Further, two adjacent arms do not influence each other's position, which is convenient for adjusting.

Other objectives, advantages and novel features of the invention will become more apparent from the following detailed description when taken in conjunction with the accompanying drawings.

DETAILED DESCRIPTION OF THE PREFERRED EMBODIMENTS

Figure 3:
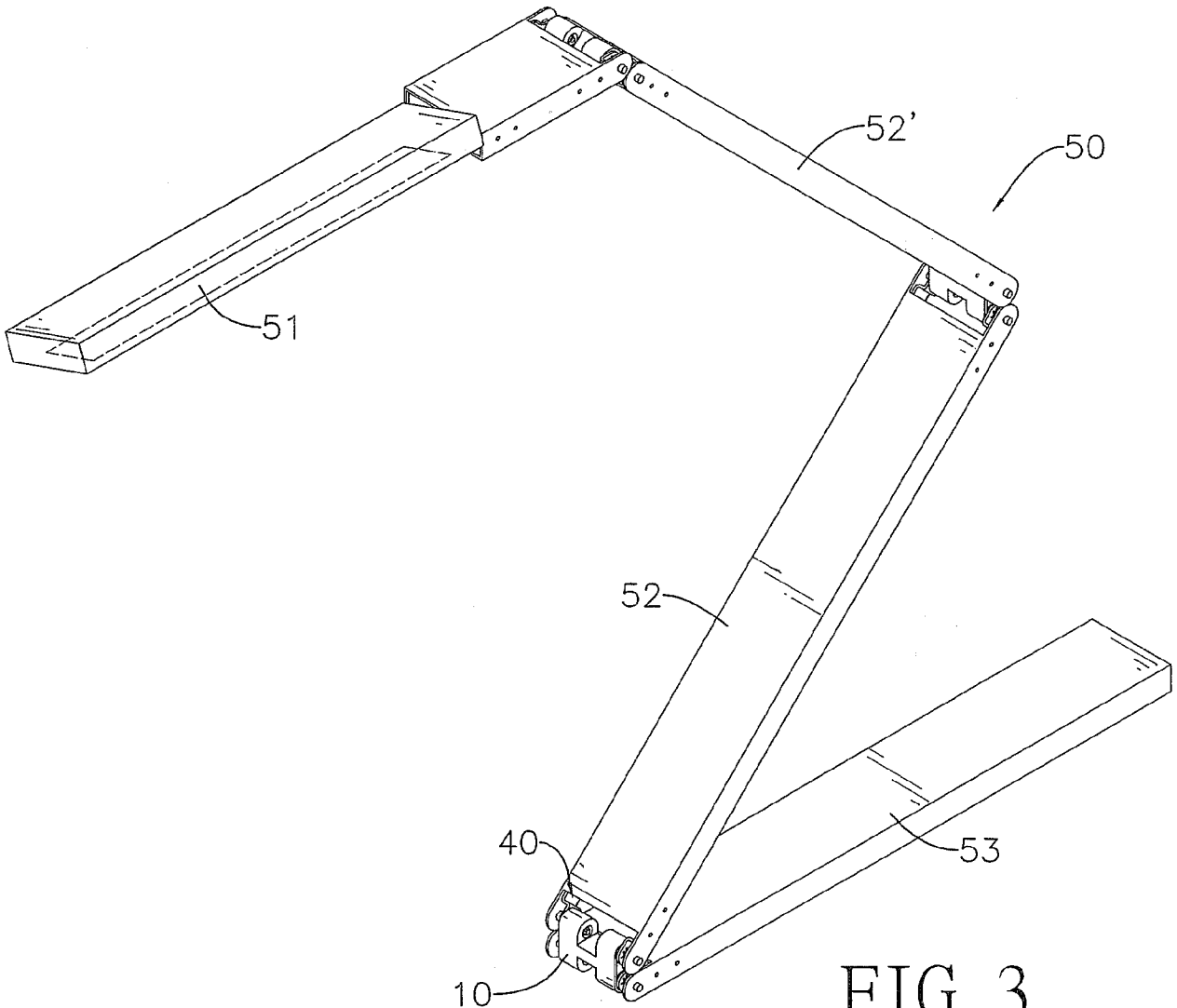
FIG. 3 is a perspective view of a lamp in accordance with the present invention.

With reference to FIG. 3, a lamp (50) in accordance with the present invention comprises multiple arms (52, 52'), a light (51), a base (53) and multiple hinges. The arms (52, 52') are sequentially connected to each other. Each arm (52, 52') has two opposite sides. The light (51) is connected to one of the arms (52, 52'). The base (53) may be connected to the other one of the arms (52, 52') and is placed on a surface such as a desk, floor or the like.

Figure 1:
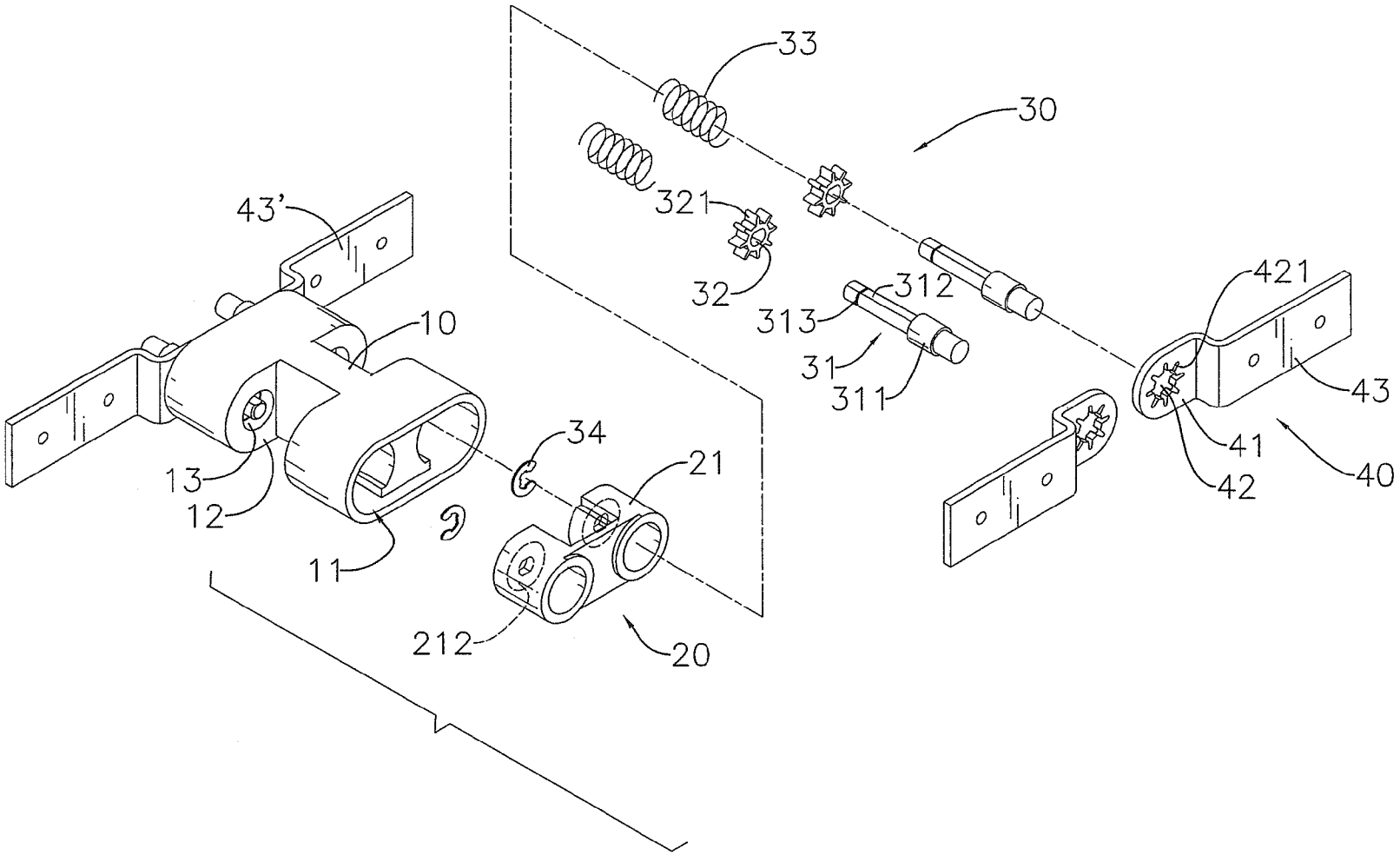
FIG. 1 is an exploded perspective view of a hinge in accordance with the present invention.

With further reference to FIG. 1, the hinges are respectively mounted between two adjacent arms (52, 52'). Each hinge comprises a stationary leaf (10), two optional bushings (20), multiple pivot assemblies (30) and multiple brackets (40, 40').

Figure 4:
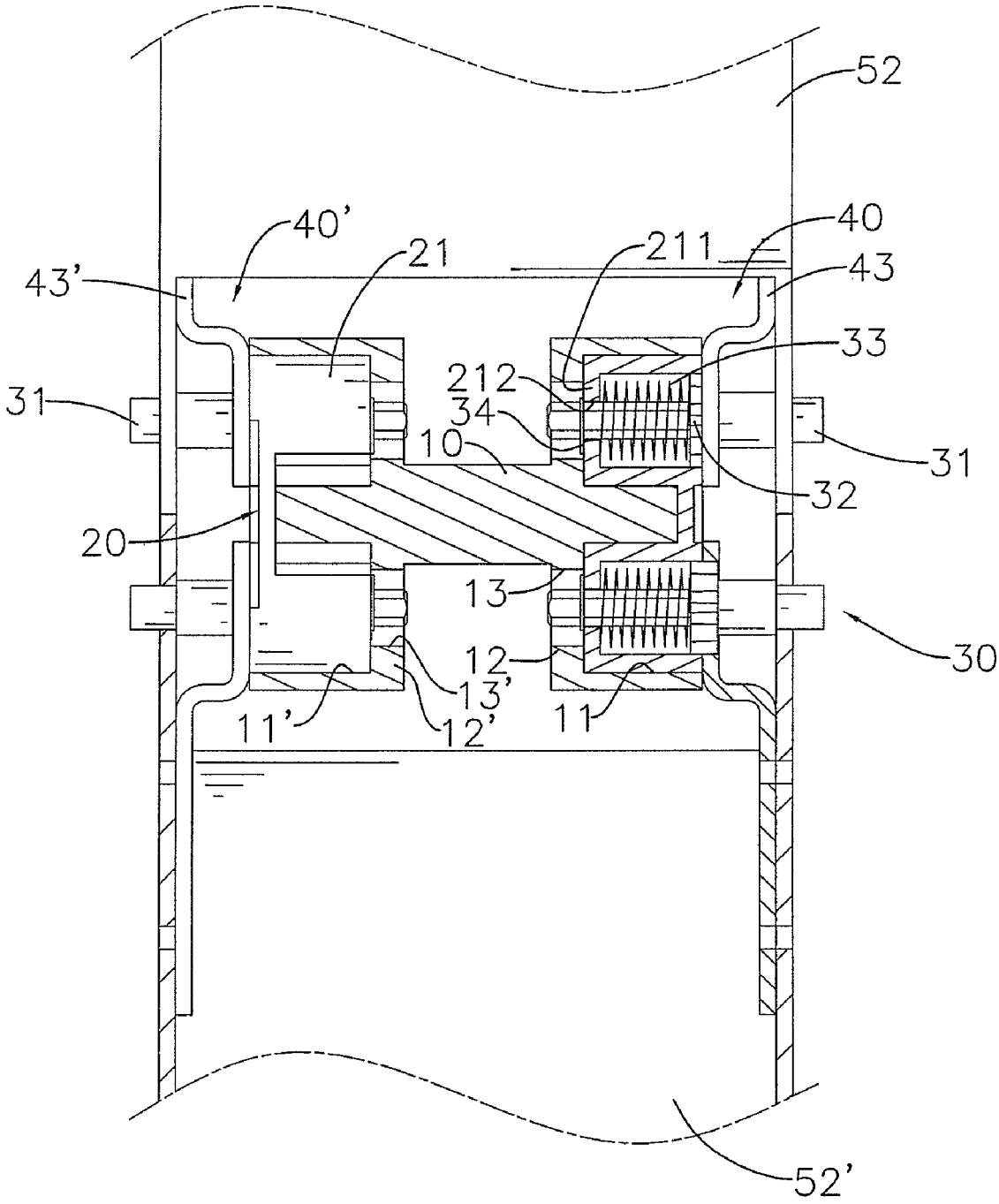
FIG. 4 is an enlarged top view in partial section of the lamp in FIG. 3, shown locked with arms extended.

With further reference to FIG. 4, the stationary leaf (10) has two opposite sides, two mounting recesses (11, 11') and multiple through holes (13, 13').

The mounting recesses (11, 11') are respectively formed in the sides of the stationary leaf (10). Each mounting recess (11, 11') has an outer open end and an inner bottom (12, 12').

The through holes (13, 13') are formed through the inner bottoms (12, 12') of the mounting recesses (11, 11'). Each through hole (13) in one inner bottom (12) of one mounting recess (11) aligns with a corresponding through hole (13') in the inner bottom (12') of the other mounting recess (11') of the stationary leaf (10).

The bushings (20) are respectively mounted in the mounting recesses (11, 11') of the stationary leaf (10). Each bushing (20) has multiple barrels (21). The barrels (21) are parallel to each other. Each barrel (21) has an outer open end, an inner bottom (211) and a through hole (212). The inner bottom (211) of each barrel (21) abuts the inner bottom (12, 12') of a corresponding mounting recess (11, 11') of the stationary leaf (10). The through hole (212) of the barrel (21) is formed through the inner bottom (211) of the barrel (21), corresponds to a through hole (13) of the corresponding mounting recess (11, 11') of the stationary leaf (10) and may be non-circular in cross-section.

The pivot assemblies (30) are respectively mounted in the mounting recesses (11, 11') of the stationary leaf (10), may be respectively mounted in the barrels (21) of the bushings (20). Each pivot assembly (30) has a shaft (31), a locking nut (32), a resilient device (33) and a fastener.

The shaft (31) is mounted through a corresponding mounting recess (11) of the stationary leaf (10), may be mounted through a corresponding barrel (21) of the bushing (20) and has a head (311) and a mounting rod (312).

The head (311) of the shaft (31) protrudes out of the outer open end of the corresponding mounting recess (11) of the stationary leaf (10).

The mounting rod (312) of the shaft (31) is formed on and protrudes from the head (311) of the shaft (31), is mounted through a corresponding through hole (13) of the stationary leaf (10), may be mounted through the through hole (212) of the corresponding barrel (21) of the bushing (20), may be non-circular in cross-section and may correspond to a corresponding non-circular through hole (212) of the barrel (21) to prevent the shaft (20) from rotating relative to the stationary leaf (10) and the bushing (20) and has a distal end. The distal end of the mounting rod (312) of the shaft (31) protrudes out of the stationary leaf (10).

The locking nut (32) is securely mounted around the mounting rod (312) of the shaft (31), abuts the head (311) of the shaft (31), is non-circular in cross-section and may have an outer edge and multiple engaging protrusions (321). The engaging protrusions (321) are radially formed on and protrude from the outer edge of the locking nut (32).

The resilient device (33) is mounted around the mounting rod (312) of the shaft (31) and has two ends. One end of the resilient device (33) is against the inner bottom (12) of the corresponding mounting recess (11) of the stationary leaf (10), or may be against the inner bottom (211) of the corresponding barrel (21), and the other end of the resilient device (33) is against the locking nut (32) in order to allow the resilient device (33) to push the head (311) of the shaft (31) toward the outer open end of the corresponding mounting recess (11) of the stationary leaf (10).

The fastener is mounted around the mounting rod (312) of the shaft (31) adjacent to the distal end of the mounting rod (312), holds the shaft (31) in a specific position in the stationary leaf (10) and may be implemented as a notch (313) and a retaining ring (34). The notch (313) is formed around the mounting rod (312) of the shaft (31) and adjacent to the distal end of the mounting rod (312). The retaining ring (34) is securely mounted in the notch (313) around the mounting rod (312) of the shaft (31) to hold the shaft (31) in the stationary leaf (10).

Figure 2:
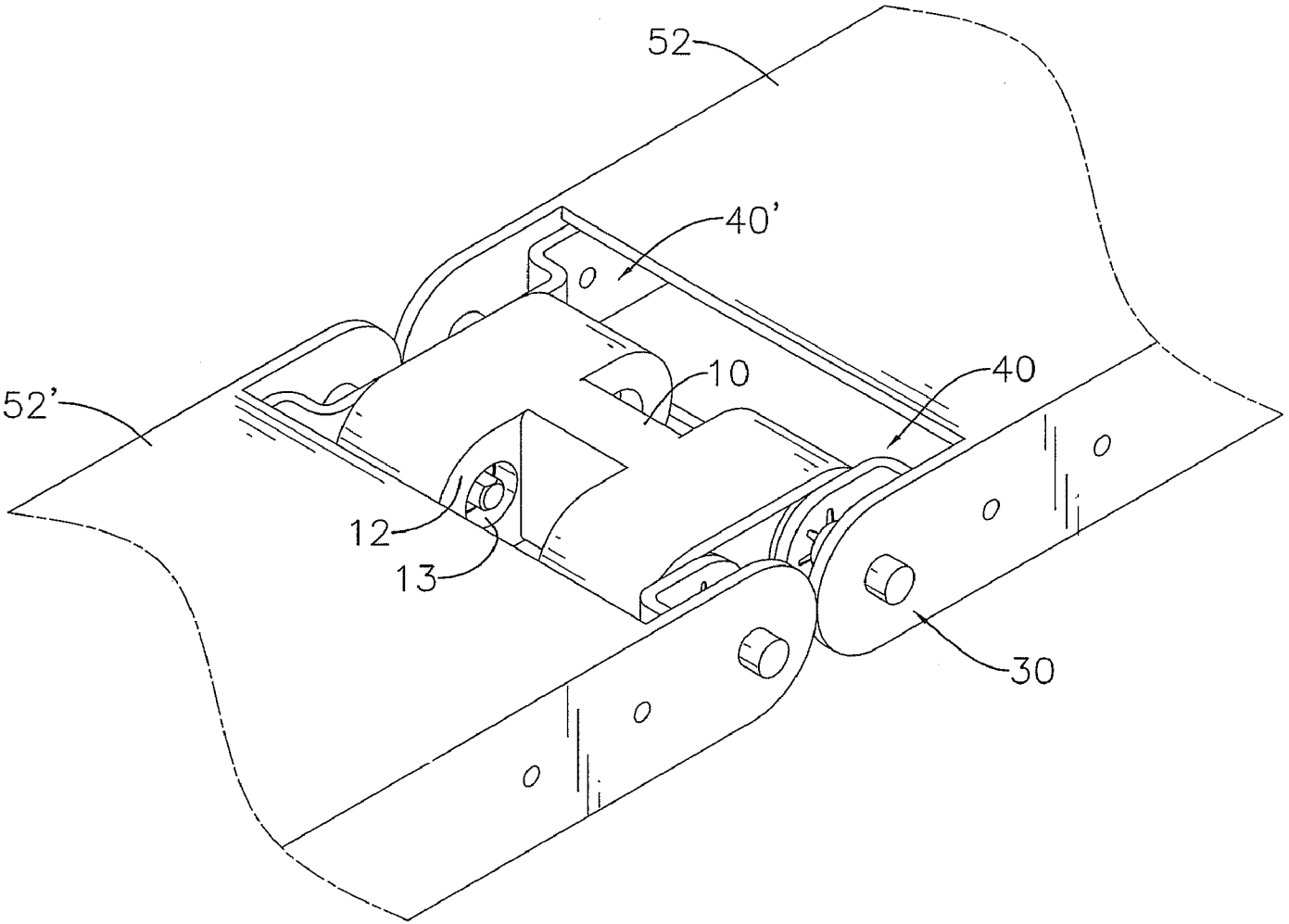
FIG. 2 is an enlarged operational perspective view of the hinge in FIG. 1, shown mounted between two arms.

With further reference to FIG. 2, the brackets (40, 40') are mounted respectively on the shafts (31) of the pivot assemblies (30) and are attached to adjacent arms (52, 52'). Each bracket (40, 40') has a pivot end (41), a locking hole (42) and a fastening end (43, 43').

The pivot end (41) is mounted around the shaft (31) of a corresponding pivot assembly (30) and may selectively engage a corresponding locking nut (32).

The locking hole (42) is formed through the bracket (40, 40'), may be formed through the pivot end (41) of the bracket (40, 40'), is mounted around the head (311) of the corresponding shaft (31), is non-circular in cross-section, corresponds to and selectively engages the locking nut (32) of the corresponding pivot assembly (30) and may have an inner edge and multiple engaging recesses (421). The engaging recesses (421) are formed in the inner edge of the locking nut (42) and correspond to the engaging protrusions (321) of the locking nut (32) of the corresponding pivot assembly (30). Therefore, the brackets (40, 40') are positioned in a specific angle with the locking holes (42) of the brackets (40, 40') engage the locking nut (32).

The fastening end (43, 43') is securely attached to a corresponding arm (52, 52') of the lamp (50). Therefore, the brackets (40, 40') are attached to the opposite sides of one arm (52).

Figure 5:
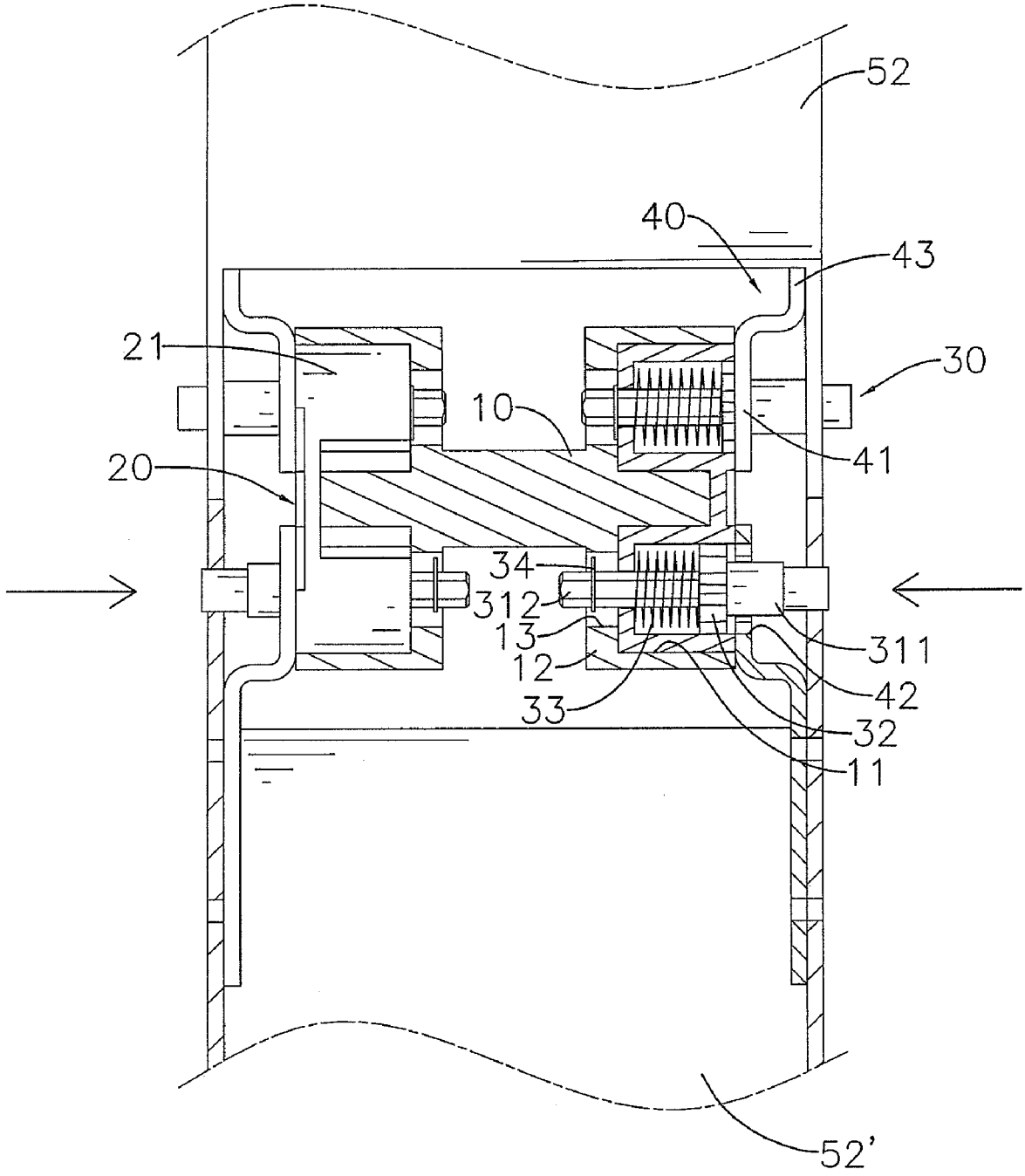
FIG. 5 is an enlarged operational top view in partial section of the lamp in FIG. 3, shown unlocked with arms extended.
Figure 6:
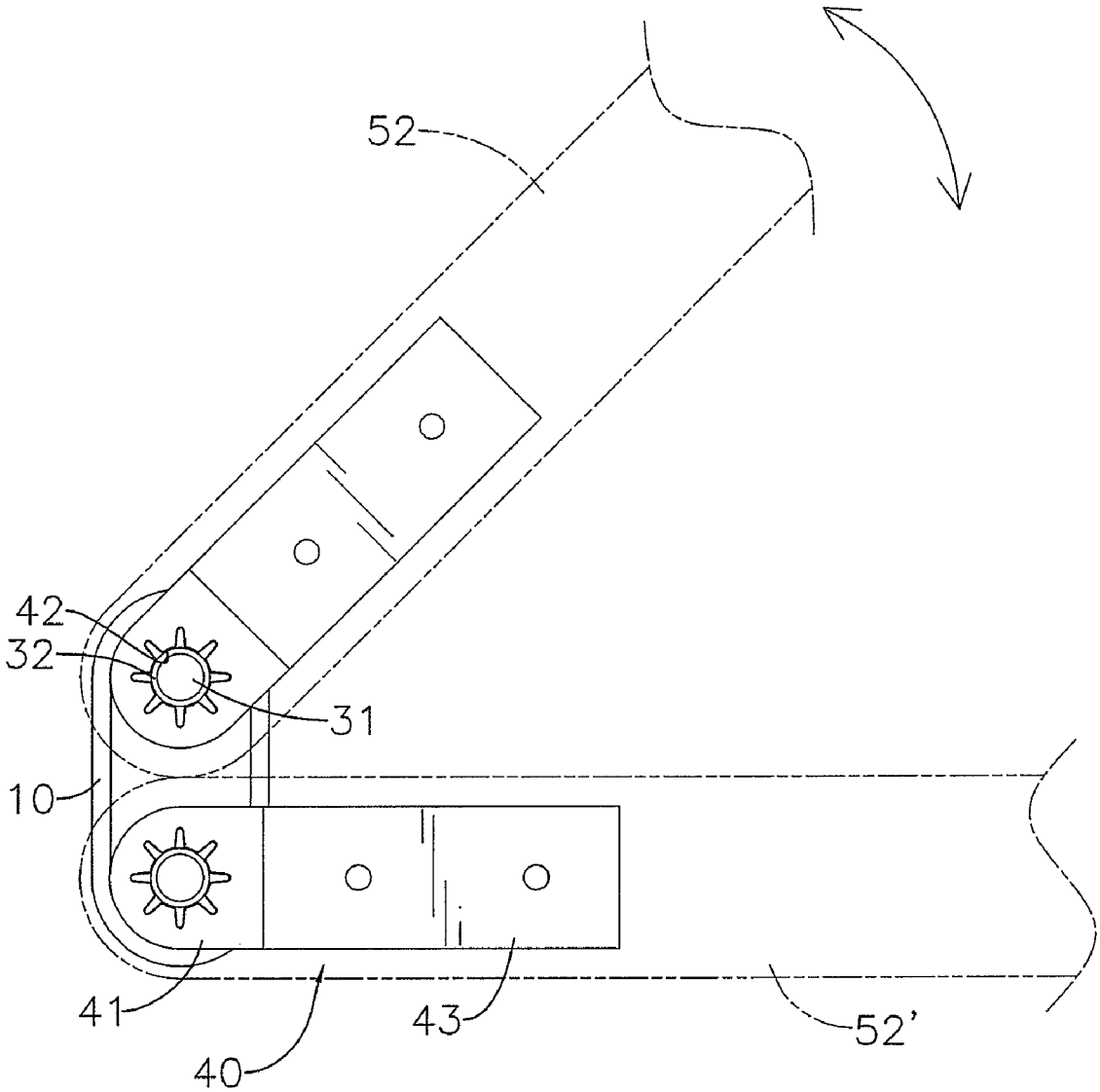
FIG. 6 is an enlarged operational side view of the lamp in FIG. 3, the arms shown in phantom lines.
Figure 7:
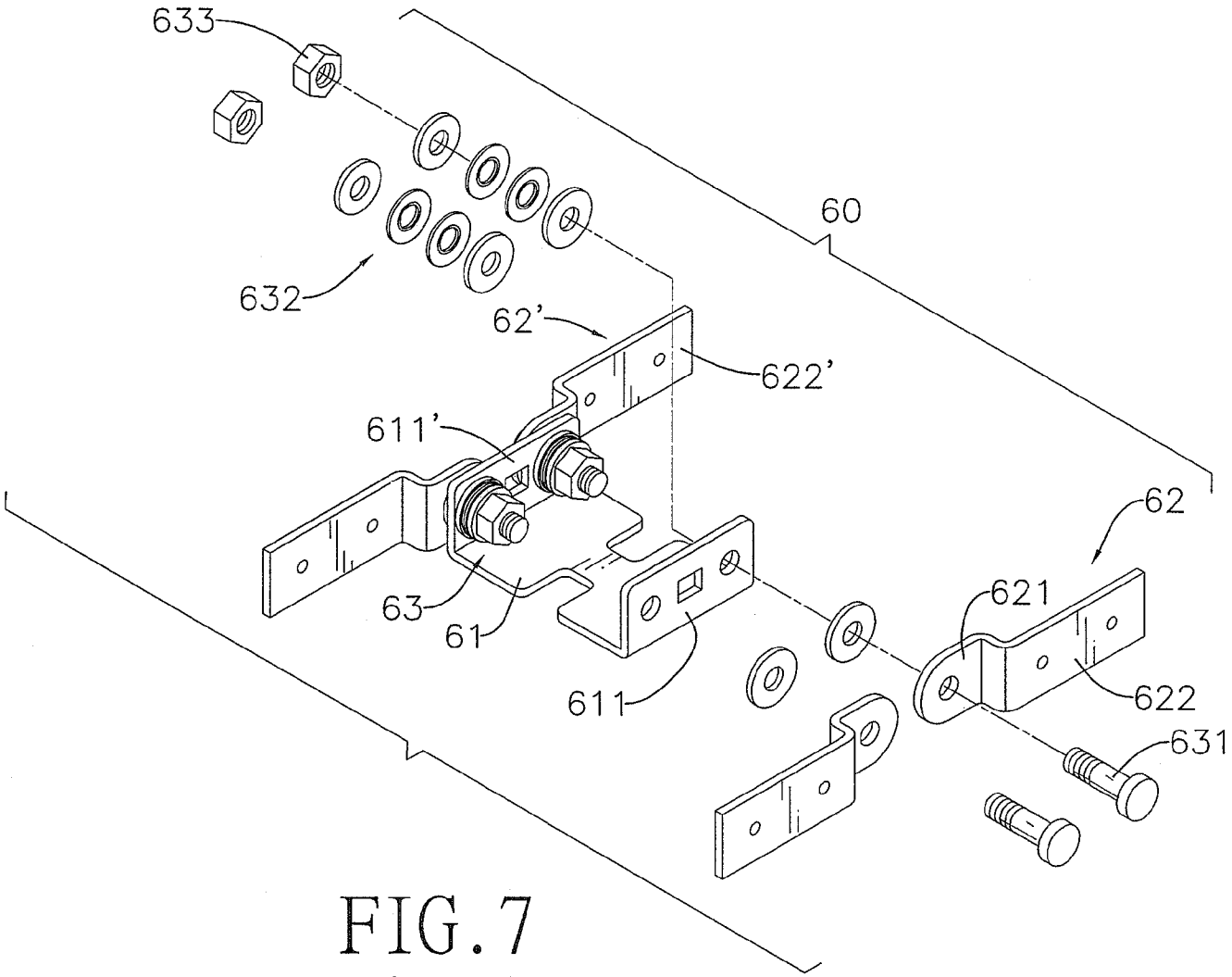
FIG. 7 PRIOR ART
FIG. 7 is an exploded perspective view of a conventional hinge in accordance with the prior art.
Figure 8:
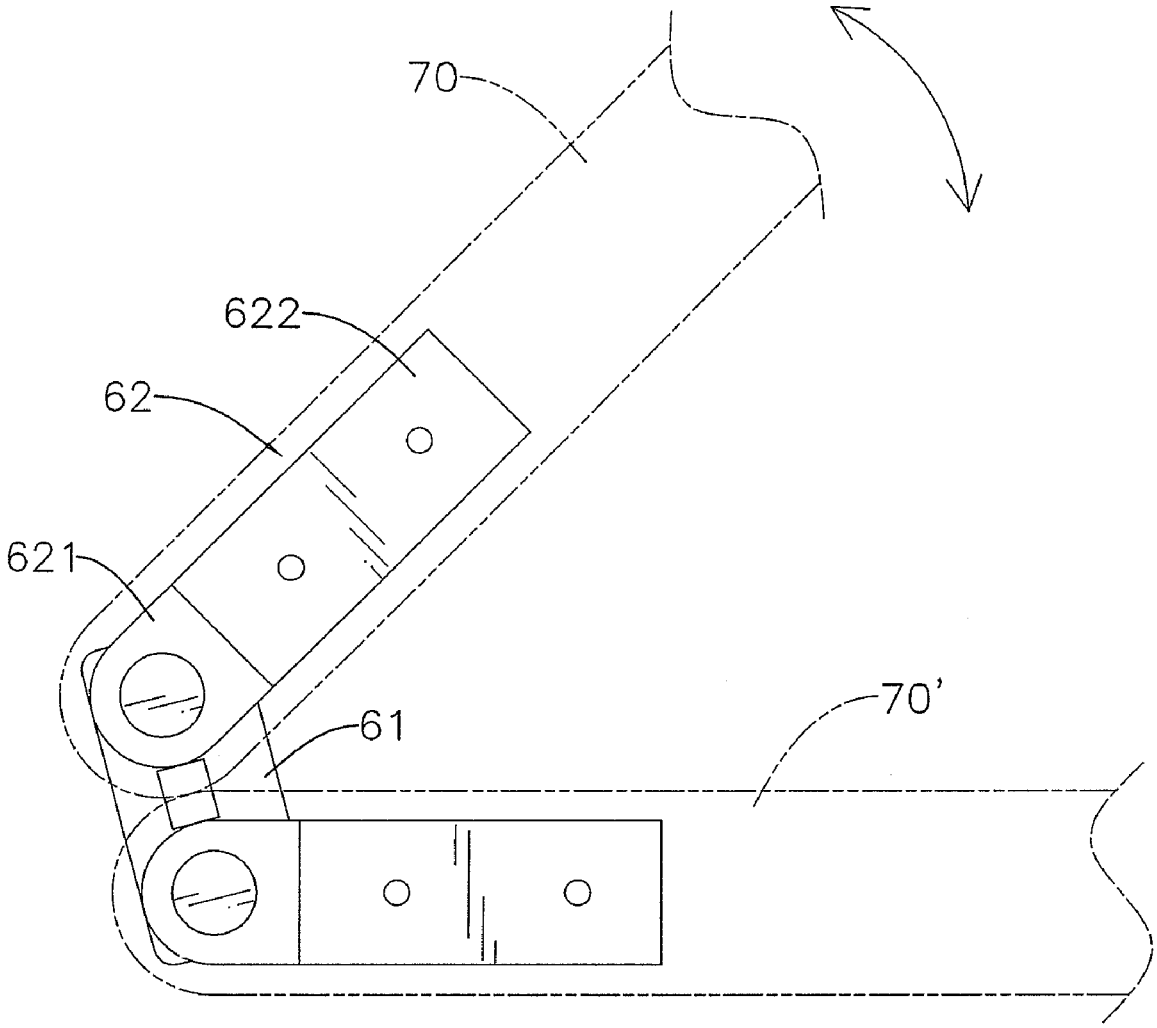
FIG. 8 PRIOR ART
FIG. 8 is a side view of the conventional hinge in FIG. 7, shown mounted between two arms in phantom lines.

With further reference to FIGS. 5 and 6, the shafts (31) of the pivot assemblies (30) being respectively mounted in the opposite sides of one arm (52) are pressed together so the head (311) of the shaft (31) slides to disengage the locking nuts (32) of the pivot assemblies (30) from the locking holes (42) of the brackets (40, 40'). Therefore, an angle of the arm (52) and the corresponding brackets (40, 40') relative to the stationary leaf (10) and the other arm (52') are adjusted. Once aligned, the shafts (31) are released and the resilient devices (33) of the corresponding pivot assemblies (30) push the locking nuts (32) to engage the locking holes (42) of the corresponding brackets (40, 40'). Therefore, the adjacent arms (52, 52') are held at a specific angle.

The hinge and the lamp with the hinge as described have the following advantages. The locking nut (32) of each pivot assembly (30) and the locking hole (42) of each bracket (40, 40') engage each other. The arms (52, 52') of the lamp (50) are fixed in a specific angle and will not change after long-term use. Furthermore, while adjusting an angle of one arm (52), the other arm (52') is fixed and the two adjacent arms (52, 52') do not influence each other, which is convenient for adjusting.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hinge comprising a stationary leaf having two opposite sides;

two mounting recesses being respectively formed in the sides of the stationary leaf, and each mounting recess having an outer open end; and an inner bottom; and multiple through holes being formed through the inner bottoms of the mounting recesses;

multiple pivot assemblies being respectively mounted in the mounting recesses of the stationary leaf and each pivot assembly having a shaft being mounted through a corresponding mounting recess of the stationary leaf and having a head protruding out of the outer open end of the corresponding mounting recess of the stationary leaf; and a mounting rod being formed on and protruding from the head of the shaft, being mounted through a corresponding through hole of the stationary leaf and having a distal end protruding out of the stationary leaf;

a locking nut being securely mounted around the mounting rod of the shaft, abutting the head of the shaft and being non-circular in cross-section;

a resilient device being mounted around the mounting rod of the shaft and pushing the head of the shaft toward the outer open end of the corresponding mounting recess of the stationary leaf; and a fastener being mounted around the mounting rod of the shaft adjacent to the distal end of the mounting rod and holding the shaft in a specific position in the stationary leaf; and multiple brackets being mounted respectively on the shafts of the pivot assemblies, and each bracket having a locking hole being formed through the bracket, being mounted around the head of the corresponding shaft, being non-circular in cross-section and corresponding to and selectively engaging the locking nut of the corresponding pivot assembly.

2. The hinge as claimed in claim 1, wherein the hinge further comprises two bushings being respectively mounted in the mounting recesses of the stationary leaf, and each bushing having multiple barrels being parallel to each other, and each barrel having an outer open end;

an inner bottom abutting the inner bottom of a corresponding mounting recess of the stationary leaf; and a through hole being formed through the inner bottom of the barrel and corresponding to a through hole of a corresponding mounting recess of the stationary leaf;

the pivot assemblies are respectively mounted in the barrels of the bushings;

the shaft of each pivot assembly is mounted through a corresponding barrel of the bushing; and the mounting rod of the shaft of each pivot assembly is mounted through the through hole of the corresponding barrel of the bushing.

3. The hinge as claimed in claim 1, wherein the locking nut of each pivot assembly further has an outer edge; and multiple engaging protrusions being radially formed on and protruding from the outer edge of the locking nut;

the locking hole of each bracket further has an inner edge; and multiple engaging recesses being formed in the inner edge of the locking nut and corresponding to the engaging protrusions of the locking nut of the corresponding pivot assembly.

4. The hinge as claimed in claim 2, wherein the locking nut of each pivot assembly further has an outer edge; and multiple engaging protrusions being radially formed on and protruding from the outer edge of the locking nut;

the locking hole of each bracket further has an inner edge; and multiple engaging recesses being formed in the inner edge of the locking nut and corresponding to the engaging protrusions of the locking nut of the corresponding pivot assembly.

5. The hinge as claimed in claim 1, wherein the fastener of the pivot assembly has a notch being formed around the mounting rod of the shaft and adjacent to the distal end of the mounting rod; and a retaining ring being securely mounted in the notch around the mounting rod of the shaft.

6. The hinge as claimed in claim 2, wherein the fastener of the pivot assembly has a notch being formed around the mounting rod of the shaft and adjacent to the distal end of the mounting rod; and a retaining ring being securely mounted in the notch around the mounting rod of the shaft.

7. The hinge as claimed in claim 3, wherein the fastener of the pivot assembly has a notch being formed around the mounting rod of the shaft and adjacent to the distal end of the mounting rod; and a retaining ring being securely mounted in the notch around the mounting rod of the shaft.

8. The hinge as claimed in claim 4, wherein the fastener of the pivot assembly has a notch being formed around the mounting rod of the shaft and adjacent to the distal end of the mounting rod; and a retaining ring being securely mounted in the notch around the mounting rod of the shaft.

9. The hinge as claimed in claim 2, wherein each through hole of each barrel of the bushing is non-circular in cross-section;

the mounting rod of the shaft of each pivot assembly is non-circular in cross-section and corresponds to a corresponding non-circular through hole of the barrel.

10. The hinge as claimed in claim 1, wherein the resilient device further has two ends, one end of the resilient device is against the inner bottom of the corresponding mounting recess of the stationary leaf and the other end of the resilient device is against the locking nut.

11. The hinge as claimed in claim 2, wherein the resilient device further has two ends, one end of the resilient device is against the inner bottom of the corresponding barrel and the other end of the resilient device is against the locking nut.

12. A lamp comprising multiple arms being sequentially connected to each other and each arm having two opposite sides;

a light being connected to one of the arms;

a base being connected to the other one of the arms; and multiple hinges being respectively mounted between two adjacent arms and comprising a stationary leaf having two opposite sides;

two mounting recesses being respectively formed in the sides of the stationary leaf, and each mounting recess having an outer open end; and an inner bottom; and multiple through holes being formed through the inner bottoms of the mounting recesses and each through hole in one inner bottom of one mounting recess aligning with a corresponding through hole in the inner bottom of the other mounting recess of the stationary leaf;

multiple pivot assemblies being respectively mounted in the mounting recesses of the stationary leaf and each pivot assembly having a shaft being mounted through a corresponding mounting recess of the stationary leaf and having a head protruding out of the outer open end of the corresponding mounting recess of the stationary leaf; and a mounting rod being formed on and protruding from the head of the shaft, being mounted through a corresponding through hole of the stationary leaf and having a distal end protruding out of the stationary leaf;

a locking nut being securely mounted around the mounting rod of the shaft, abutting the head of the shaft and being non-circular in cross-section;

a resilient device being mounted around the mounting rod of the shaft and pushing the head of the shaft toward the outer open end of the corresponding mounting recess of the stationary leaf; and a fastener being mounted around the mounting rod of the shaft adjacent to the distal end of the mounting rod and holding the shaft in a specific position in the stationary leaf; and multiple brackets being mounted respectively on the shafts of the pivot assemblies and being attached to adjacent arms, and each bracket having a locking hole being formed through the bracket, being mounted around the head of the corresponding shaft, being non-circular in cross-section and corresponding to and selectively engaging the locking nut of the corresponding pivot assembly.

* * * * *